United States Patent [19]

Reece

[11] 4,329,809

[45] May 18, 1982

[54] BUCKING AMUSEMENT APPARATUS

[76] Inventor: Vernon N. Reece, Box 167, Dierks, Ark. 71833

[21] Appl. No.: 208,020

[22] Filed: Nov. 18, 1980

[51] Int. Cl.[3] ..... A63H 11/10; A63D 1/00

[52] U.S. Cl. ..... 46/101; 46/108; 46/204; 272/53.1

[58] Field of Search ..... 46/106, 204, 201, 202, 46/97, 98, 99, 106, 107, 108, 109, 110, 111, 112, 101; 272/52, 52.5, 53.1, 53.2, 56; 280/1.1 R, 1.1 A, 229, 1.193, 1.22, 1.165, 1.182

[56] References Cited

U.S. PATENT DOCUMENTS

| | | | |
|---|---|---|---|
| 956,243 | 4/1910 | Welsh | 272/52 |
| 1,646,606 | 10/1927 | Wilson | 280/1.22 |
| 2,843,380 | 7/1958 | Simon et al. | 273/53.1 |
| 4,093,188 | 6/1978 | Petersen | 272/52 |
| 4,162,084 | 7/1979 | Mikina | 280/229 |

*Primary Examiner*—Robert Peshock
*Assistant Examiner*—Michael J. Foycik
*Attorney, Agent, or Firm*—Head & Johnson

[57] ABSTRACT

A multi-purpose amusement apparatus simulating the action of a bucking animal, such as a bull or horse, and which is an apparatus for mounting by a person, the apparatus generally simulating the appearance of the animal and installed in the bed of a pick-up truck, a heavy spring device supporting the apparatus with the bed of the truck, and eccentric rear wheels provided for the truck for transmitting an up and down motion to the bed of the truck for producing an action for the apparatus generally simulating the movement of a bucking animal.

7 Claims, 1 Drawing Figure

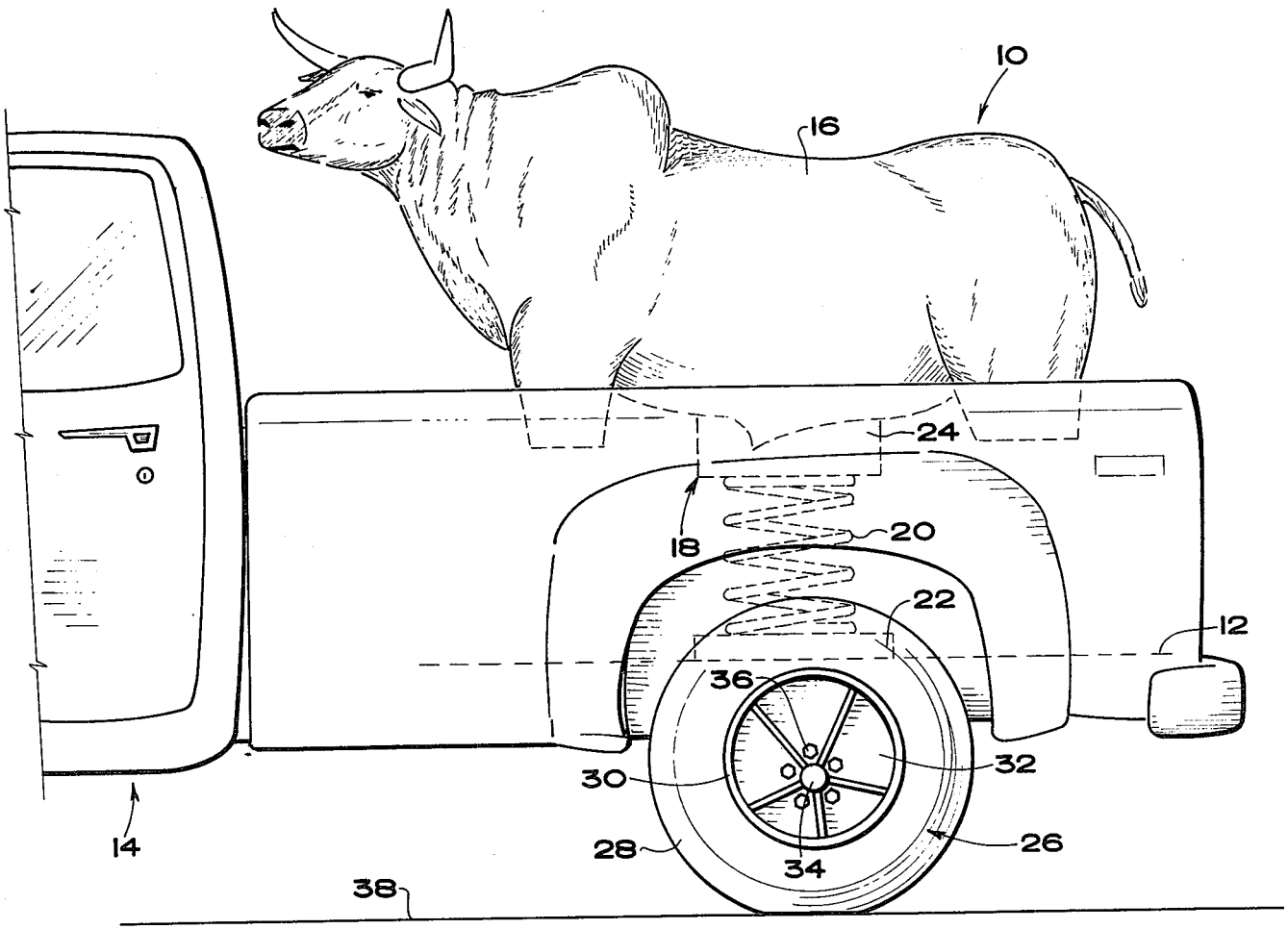
10
12
14
16
18
20
22
24
26
28
30
32
34
36
38

BUCKING AMUSEMENT APPARATUS

BACKGROUND OF THE INVENTION

1. Field of the Invention

This invention relates to improvements in multi-purpose amusement devices and more particularly, but not by way of limitation to an exercising and amusement apparatus simulating the action of a bucking animal.

2. Description of the Prior Art

There is an increasing interest today in exercise programs for enhancing personal health, and many exercising devices which combine exercise with entertainment or amusement have been developed. One of the presently popular devices of this type is apparatus simulating the action of a bucking bronco, bull, or the like. These devices normally comprise a seating portion generally resembling the torso of an animal and mounted on an upstanding post in such a manner that the seating portion is jostled or moved about in an action similar to that of the bucking animal. These devices are usually electrically actuated and include complicated cams, gear, and the like, to produce the end result. Consequently, the apparatus is usually quite expensive to manufacture and install at the site of utilization. Furthermore, most of the devices are not designed for utilization in relatively remote areas wherein a source of power may not be readily available.

In addition, it is frequently desirable to advertise coming activites, such as advance notification of a future rodeo attraction, or the like. It is common practice to drive vehicles around the city streets, or the like, with signs carried on the vehicle, or public address systems announcing the coming event. Of course, it is always an advantage to introduce a new means of attracting attention for such advertising purposes since the old and well known devices begin to attract less attention as time passes.

SUMMARY OF THE INVENTION

The present invention contemplates a novel exercising and amusement device of the type simulating the action of a bucking bronco, bull, or the like, which has been particularly designed and constructed for overcoming the foregoing advantages. The above apparatus comprises a structure generally resembling the animal and adapted to receive the person thereon during the use thereof. The animal structure is installed or supported in the bed of the usual pick-up truck by a suitable yieldable means, such as a heavy spring apparatus, or the like, which provides a relatively erratic action for the structure during use of the apparatus such as might be encountered while riding a bucking animal. The rear wheels of the pick-up truck are eccentrically mounted on the outer ends of the rear axle and provide an up and down motion for the bed of the pick-up truck as the truck moves over a driving course, such as an endless track, or the like. Alternately, the rear wheels of the pick-up truck may rest on a movable conveyor belt apparatus to provide the up and down action of the bed of the truck. As the bed of the truck moves up and down, a jostling action is provided for the spring supported animal structure, and the person sitting astride the animal structure is treated to an amusing episode which is not only "fun" but provides exercise for the user of the apparatus. The novel exercising and amusement apparatus is simple and efficient in operation and economical and durable in construction.

BRIEF DESCRIPTION OF THE DRAWINGS

The single FIGURE is a side elevational view of an exercising and amusement apparatus embodying the invention and shown installed in the bed of a usual pick-up truck, with portions of the truck being omitted for purposes of illustration.

DETAILED DESCRIPTION OF THE PREFERRED EMBODIMENT

Referring to the drawings in detail, reference character 10 generally indicates an exercising and amusement apparatus comprising adapted to be installed on the bed 12 of a suitable vehicle 14, such as a pick-up truck. The apparatus 10 comprises a structure 16 configured to represent a suitable animal such as is commonly "riden" during a bucking action. For example, a bull is illustrated herein, but it is to be understood that the configuration may represent a bronco, pony, or substantially any desired animal. It may be preferable to shorten the leg portions of the animal, as illustrated herein, but there is no intention of limiting the structure to a legless configuration.

The structure 16 is supported above the truck bed 12 by a suitable yieldable means 18 which preferably comprises a strong or stout helical spring 20 having one end anchored on the outer or upper face of a suitable base member 22 and the opposite end anchored to a suitable block means 24 which is secured to the underside of the structure 16. It may be preferable to anchor the ends of the spring 20 within suitable recesses (not shown), or it may be preferable to provide bosses or core members (not shown) extending into the center of the spring 20 for facilitating the movement of the apparatus 10 as will be hereinafter set forth.

The rear wheels 26 (only one of which is shown herein) are preferably provided with the usual pneumatic rubber tire 28 secured in the usual manner around a rim 30 of a central wheel hub member 32. The hub member 32 is provided with an off center bore (not shown) for receiving one end of the vehicle axle means 34 therethrough. The usual lug bolts 36 are provided for securing the wheel hub 32 in place in the normal or well known manner. The off center disposition of the wheel hub bore provides an eccentric mounting for the rear wheels 26 with respect to the longitudinal axis of the axle means 34 thus providing an eccentric rotational action of the wheel 26 about the axle means 34.

In use, the vehicle or pick-up truck 14 may be driven along a suitable roadbed 38, and as the rear wheels 26 roll over the surface of the roadbed 38, the axle means 34 will be moved upwardly and downwardly with respect to the surface of the roadbed. This causes the bed 12 of the vehicle 14 to move alternately upwardly and downwardly. The up and down movement of the bed 12 causes the spring means 20 to jostle the structure 16 in a somewhat erractic manner thus providing a movement of the structure generally similar to the bucking movement of a live animal. The rider (not shown) of the structure 16 will thus be subjected to an interesting, exicting treatment which affords both amusement and exercise.

Of course, it is to be noted that the vehicle 14 may be situated in such a manner that the rear wheels 26 thereof are resting on the upper surface of an endless conveyor belt (not shown) or the like, and as the conveyor belt moves through its endless path, the wheels 26 will be rotated in a manner providing for an up and down motion for the axle means 34 to produce the same action for the structure 16 as hereinbefore set forth.

Whereas the apparatus provides combined exercise and entertainment for the user thereof, it is to be noted that the apparatus 10 may also be utilized for other purposes, such as for advertising purposes announcing the coming of a future activity. The vehicle 14 may be driven around city streets, or the like, in a manner wherein the eccentric or erractic action of the structure 16 will catch the attention of bystanders, and call attention to any advertising material which might be inscribed on the sides of the vehicle 14, or the like. Thus, the apparatus 10 has many uses.

From the foreging it will be apparent that the present invention provides a novel exercise and amusement apparatus comprising a structure simulating an animal mounted on the bed of a pick-up truck by suitable yieldable means for producing erratic movement of the animal upon actuation of the yieldable means. In addition, the rear wheels of the vehicle are eccentrically mounted with respect to the rear axle means of the vehicle whereby the axle is moved alternately upwardly and downwardly as the rear wheels are rotated about the axle means. This causes the bed of the vehicle to impart a springing action to the yieldable means for producing the erractic action for the animal supported thereby.

Whereas the present invention has been described in particular relation to the drawings attached hereto, it should be understood that other and further modifications, apart from those shown or suggested herein may be made within the spirit and scope of this invention.

What is claimed is:

1. A multi-purpose amusement apparatus comprising structure means simulating the appearance of an animal disposed in the bed of a pick-up truck, yieldable mounting means contained in the bed for securing the structure means within the bed of the pick-up truck, and eccentrically mounted rear wheels provided for the vehicle to impart an up and down motion for the bed of the pick-up truck upon rotation of the wheels whereby the yieldable mounted means produces an erratic action for the structure means.

2. A multi-purpose amusement apparatus as set forth in claim 1 wherein the yieldable mounting means comprises strong helical spring means having one end anchored in the proximity of the bed of the pick-up truck and having the opposite end anchored in the proximity of the underside of the structure means.

3. A multi-purpose amusement apparatus as set forth in claim 1 wherein the eccentrically mounted rear wheels roll along a supporting surface to provide said up and down motion for the bed of the pick-up truck.

4. A multi-purpose amusement apparatus as set forth in claim 3 wherein the supporting surface is a roadbed.

5. A multi-purpose amusement apparatus as set forth in claim 3 wherein the support surface is the upper surface of an endless conveyor belt.

6. A multi-purpose amusement apparatus as set forth in claim 1 wherein the appearance of the animal simulates a bull.

7. A multi-purpose amusement apparatus as set forth in claim 1 wherein the appearance of the animal simulates a horse.

* * * * *